US006153144A

United States Patent [19]

Byma

[11] Patent Number: 6,153,144

[45] Date of Patent: Nov. 28, 2000

[54] METHOD OF MAKING A PART USING SELECTIVE PARTICULATE DEPOSITION

[75] Inventor: George B. Byma, Haar, Germany

[73] Assignee: Lear-Donnelly Overhead Systems, L.L.C., Novi, Mich.

[21] Appl. No.: 09/168,500

[22] Filed: Oct. 8, 1998

[51] Int. Cl.[7] ..... B27N 3/08

[52] U.S. Cl. ..... 264/511; 264/113; 264/121; 264/122; 264/517

[58] Field of Search ..... 264/511, 553, 264/554, 113, 122, 257, 546, 517, 121, 510, 518, 516; 427/197, 200

[56] References Cited

U.S. PATENT DOCUMENTS

| | | | |
|---|---|---|---|
| 3,410,936 | 11/1968 | Juras | 264/90 |
| 3,872,199 | 3/1975 | Ottinger | 264/46.4 |
| 3,992,238 | 11/1976 | Johns . | |
| 4,609,519 | 9/1986 | Pichard et al. | 264/510 |
| 4,795,335 | 1/1989 | Farrington et al. | 425/82.1 |
| 4,840,832 | 6/1989 | Weinle et al. . | |
| 5,164,254 | 11/1992 | Todd et al. | 428/290 |
| 5,342,565 | 8/1994 | Goren | 264/74 |
| 5,407,631 | 4/1995 | Salisbury | 264/517 |
| 5,536,341 | 7/1996 | Kelman | 156/62.2 |
| 5,561,866 | 10/1996 | Ross . | |
| 5,683,796 | 11/1997 | Kornylo et al. . | |
| 5,775,565 | 7/1998 | Sand . | |
| 5,779,793 | 7/1998 | Sand . | |
| 5,843,365 | 12/1998 | Pinson et al. | 264/517 |
| 5,853,628 | 12/1998 | Varona | 264/6 |

OTHER PUBLICATIONS

Jacques H. Gerard and Michael Jander, "Owens–Corning P–4 Technology", 48th Annual Conference, Composites Institute, The Society of the Plastics Industry, Inc., Feb. 8–11, 1993, 1/Session 9–F, pp. 1–7.

*Primary Examiner*—Jan H. Silbaugh
*Assistant Examiner*—Dae Young Lee
*Attorney, Agent, or Firm*—Brooks & Kushman P.C.

[57] ABSTRACT

A method of making a headliner assembly includes providing a porous member having first and second sides. A negative pressure is developed on the second side of the porous member, and particulate material is selectively deposited proximate the first side of the porous member to form a particulate layer having an outline that corresponds with a desired outline of the headliner assembly. The particulate material is drawn toward the first side of the porous member by the negative pressure developed on the second side of the porous member. The particulate layer is then thermoformed to form the headliner assembly.

34 Claims, 2 Drawing Sheets

METHOD OF MAKING A PART USING SELECTIVE PARTICULATE DEPOSITION

TECHNICAL FIELD

This invention relates to a method of making an automotive part using selective particulate deposition.

BACKGROUND ART

A prior method of making automotive parts, such as headliners, includes positioning a batt of fibrous material in a mold, thermoforming the batt, and trimming the batt to form the headliner. Such a method is disclosed in U.S. Pat. No. 4,840,832 to Weinle et al. Because the batt typically has a uniform composition and thickness, it is difficult to vary properties, such as density, strength and sound absorptivity, at different points around the headliner. Furthermore, because the headliner typically requires numerous cutouts for such things as a sunroof, sunvisors, pillars and dome lights, this method results in significant offal, or excess material that is usually discarded.

U.S. Pat. No. 5,683,796 discloses another method of making a headliner which includes spraying a layer of foamable material, such as liquid polyurethane, on a cover layer. The foamable material is permitted to free-rise or expand so that it has a generally constant density throughout. Consequently, this method is not useful to produce a headliner having different densities at different locations on the headliner. Furthermore, because the foamable material has a uniform composition, it is difficult to provide a headliner with multiple and distinct features, such as high strength reinforcing zones and resilient energy management zones.

DISCLOSURE OF INVENTION

The invention overcomes the above shortcomings by providing a method of making an automotive part, such as a headliner assembly, which includes selectively depositing particulate material to achieve a desired outline and desired properties of the headliner assembly. The method comprises providing a porous member having first and second sides; developing a negative pressure on the second side of the porous member; selectively depositing particulate material proximate the first side of the porous member to form a particulate layer having an outline that corresponds with a desired outline of the headliner assembly, the particulate material being drawn toward the first side of the porous member by the negative pressure developed on the second side of the porous member; and forming the particulate layer into a desired shape of the headliner assembly.

Another aspect of the invention is a method of making a vehicle headliner assembly comprising positioning a permeable cover layer on a first side of a porous member; developing a negative pressure on a second side of the porous member; selectively depositing particulate material from at least two different sources of particulate material at different areas on the cover layer in amounts commensurate with desired thicknesses of the headliner assembly at the different areas to form a particulate layer, the particulate material being drawn to the cover layer by the negative pressure developed on the second side of the porous member; and thermoforming the cover layer and the particulate layer to form the headliner assembly.

Accordingly, it is an object of the invention to provide a method of making a headliner assembly which includes selectively depositing particulate material so as to define the basic outline of the headliner assembly, thereby significantly reducing the amount of offal as compared with prior art methods.

It is another object of the invention to provide a method of making a headliner assembly which includes selectively depositing particulate material so as to achieve desired properties of the headliner assembly.

A more specific object of the invention is to provide a method of making a headliner assembly which includes selectively depositing particulate material to form a particulate layer such that the layer includes at least two portions having different densities.

Another more specific object of the invention is to provide a method of making a headliner assembly which includes selectively depositing particulate material to form at least one reinforcing zone in the headliner.

Still another more specific object of the invention is to provide a method of making a headliner assembly which includes selectively depositing particulate material including resilient particles to form at least one energy management zone in the headliner.

BEST MODE FOR CARRYING OUT THE INVENTION

Figure 1:
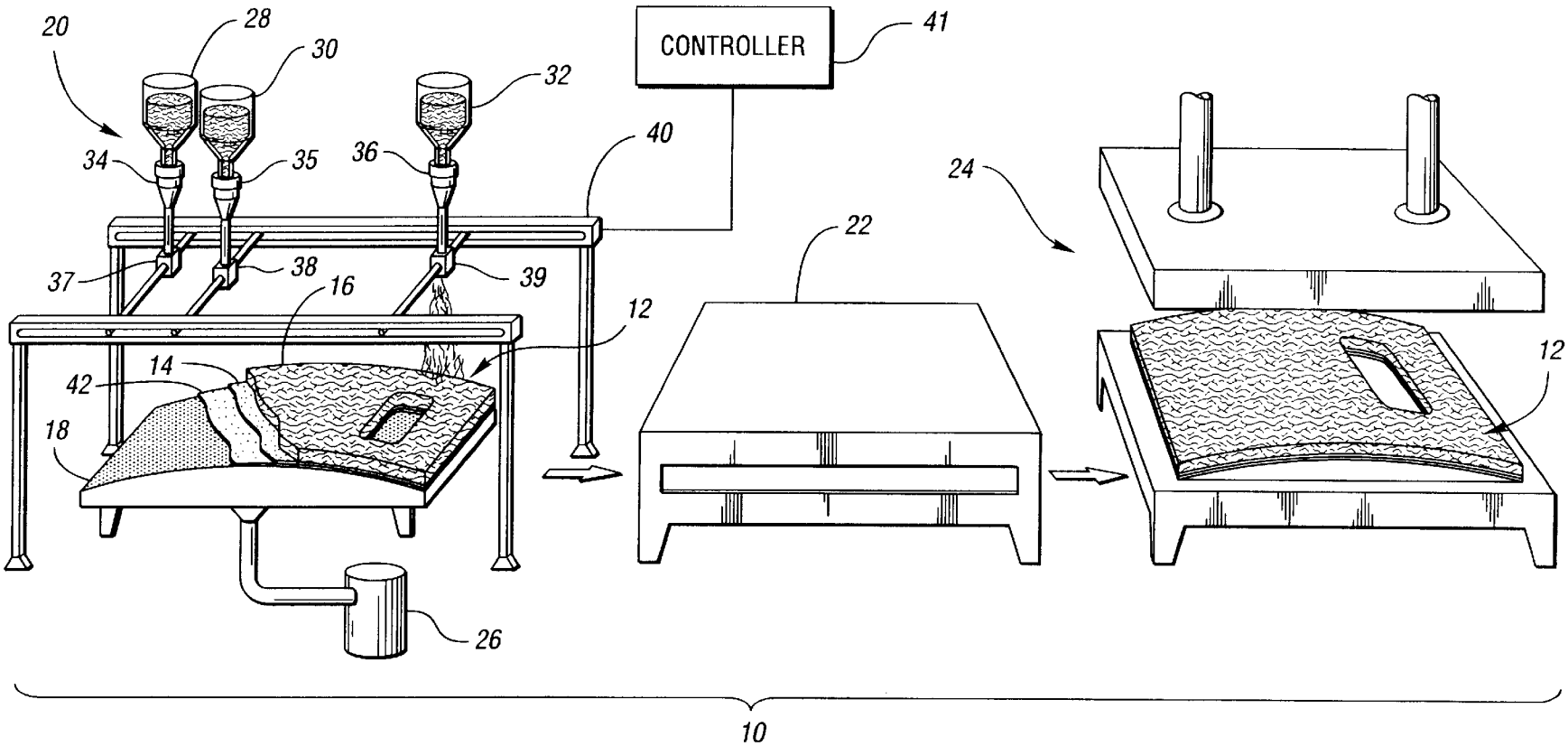
FIG. 1 is a schematic perspective view of an apparatus for practicing the method according to the invention.

With reference to the drawings, the preferred embodiments of the invention will be described. FIG. 1 shows an apparatus 10 according to the invention utilized in manufacturing a part, such as a motor vehicle headliner assembly 12 having a cover layer 14 and a preform or particulate layer 16. The apparatus 10 includes a porous support member 18, a particulate depositing device such as a particulate applicator 20, a heating device such as an oven 22, and a mold 24. The porous member 18 may be any suitable porous structure, such as a perforated sheet, screen or mesh, that is configured to retain particulate material deposited thereon while permitting air to pass therethrough. Furthermore, the porous member 18 may be made of any suitable material, such as metal or plastic, and preferably has a shape generally conforming to the desired final shape of the headliner assembly 12. A vacuum source 26 is preferably connected to the porous member 18 for drawing air through the porous member 18.

The particulate applicator 20 is preferably disposed above the porous member 18 for selectively blowing or otherwise depositing particulate material onto the porous member 18. The particulate applicator 20 includes one or more sources 28, 30 and 32 of different material, each of which contains one or more types of formable natural and/or synthetic material. The material is preferably in the form of particles such as fibers, beads and/or pellets. However, the material may have any suitable configuration such as continuous fibers. The natural material may be any suitable material such as jute, wood, kenaf, flax and/or hemp. The synthetic material is preferably a thermoplastic material such as polyester, nylon, polyethylene and/or polypropylene. Alternatively, the synthetic material may be any suitable polymeric material, including thermosetting material, or other synthetic material such as fiberglass. Additionally, metal particles may be used if desired. One of the material sources 28, 30 and 32 also preferably includes a heat-activatable binder material.

Each of the material sources 28, 30 and 32 is preferably connected to a dedicated chopping or cutting device 34, 35 and 36, respectively, for chopping the material into particles such as fibers, beads and/or pellets, if, for example, the material in the material sources is not already in particle form, or if smaller size particles are required for a particular application. Consequently, the material sources 28, 30 and 32 may contain bales or spools of densely packed material, such as fibers, which require significantly less storage space compared with preformed lofted layers of fibrous material. Alternatively, one or more of the cutting devices 34, 35 and 36 may be eliminated if, for example, the material sources 28, 30 and 32 contain preformed particles that do not require chopping or cutting such as polystyrene beads. Each of the cutting devices 34, 35 and 36 is connected to a respective applicator head 37, 38 and 39 for blowing or otherwise depositing the particles onto the porous member 18. The applicator heads 37, 38 and 39 are preferably movably connected to a frame 40 such that each applicator head can be moved along x arid y axes over the entire porous member 18. In addition, the particulate applicator 20 may be configured such that each applicator head 37, 38 and 39 is movable along a z axis as well. The particulate applicator 20 also preferably includes a programmable controller 41 for controlling movement of the applicator heads 37, 38 and 39 and deposition of particles onto the porous member 18. Alternatively, the particulate applicator may have any suitable configuration sufficient to deposit material onto the porous member 18, such as a robotic arm connected to one or more sources of material and movable along x, y and z axes.

The method according to the invention of making the headliner assembly 12 includes positioning the cover layer 14 on the porous member 18. The cover layer 14 may comprise any suitable material such as cloth, fiber, carpet and/or powdered vinyl. Alternatively, the cover layer 14 may be applied to a previously formed particulate layer 16, or the cover layer 14 may be eliminated if the characteristics of the particulate layer 16 are aesthetically satisfactory. A scrim layer 42 may also be placed on the porous member 18 for assisting in removal of the headliner assembly 12 from the porous member 18. In addition or as an alternative, the scrim layer 42 may be used to support the cover layer 14 if, for example, the cover layer 14 comprises powdered vinyl, or to support the particulate layer 16 if, for example, the cover layer 14 is not used or is placed on top of the particulate layer 16. Depending on the application, the scrim layer 42 may or may not become part of the headliner assembly 12. For example, the scrim layer 42 may only be needed to assist in removal of the headliner assembly 12 from the porous member 18, and may be discarded after such removal has occurred.

The method continues by feeding material from one or more of the sources 28, 30 and 32 into one or more of the cutting devices 34, 35 and 36 where the material is chopped into particles such as fibers. Next, the chopped particles are selectively deposited onto the cover layer 14 by one or more of the applicator heads 37, 38 and 39 to form the particulate layer 16. In other words, because the applicator heads 37, 38 and 39 are preferably moveable along x and y axes above the cover layer 14, particles are deposited at different areas on the cover layer 14 in amounts commensurate with desired thicknesses of the headliner assembly 12 at the different areas.

The vacuum source 26 is preferably activated simultaneously so as to draw air through the cover layer 14 and the porous member 18, thereby drawing the particles against the cover layer 14 and the porous member 18. Because the porous member 18 preferably has a shape conforming to the final shape of the headliner assembly 12, the particulate layer 16 is preferably formed so as to have a shape substantially the same as the final shape of the headliner assembly 12. Alternatively, the particulate layer 16 and the porous member 18 may have any suitable shape.

Figure 2:
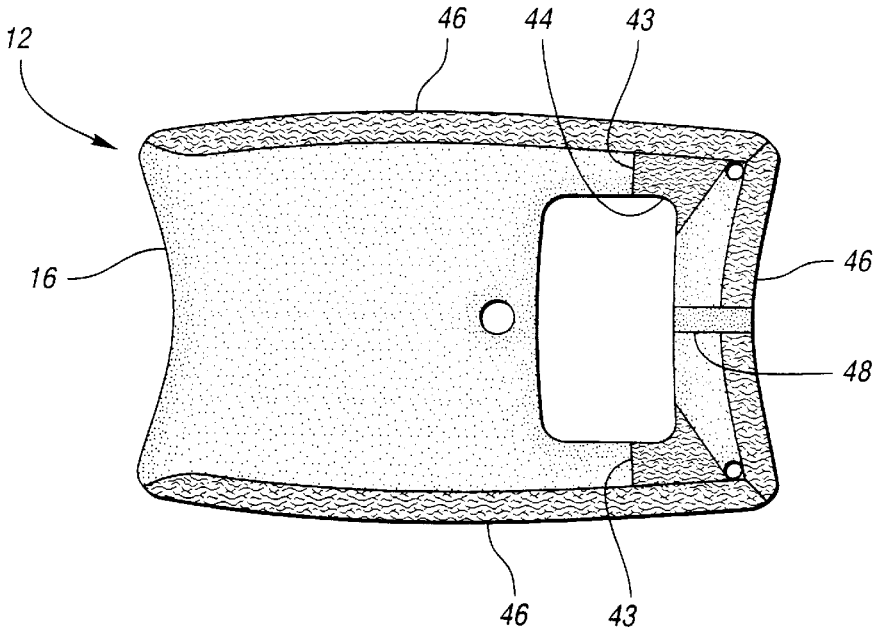
FIG. 2 is a top view of a headliner assembly made by the method according to the present invention.

Because the particles are selectively deposited onto the cover layer 14, the concentration, orientation and/or type or types of particles can be controlled to achieve various desired properties or characteristics of the headliner assembly 12. For example, particles having different densities can be deposited in different areas of the particulate layer 16 so as to vary the density of the particulate layer 16. As another example, reinforcing zones 43, as shown in FIG. 2, can be formed within the particulate layer 16 by applying a relatively dense concentration of high strength particles, such as fiberglass, in areas requiring greater rigidity, such as around a sunroof opening 44 or other openings in the headliner assembly 12. As another example, energy management zones 46 can be formed within the particulate layer 16 by depositing a relatively dense concentration of plastic beads such as expanded polypropylene beads. As another example, conductive particles such as carbon or copper fibers may be selectively deposited within the particulate layer 16 to form a conductive conduit 48 for providing electrical power to such components as dome lights or map lights. Electrically insulating particles such as fiberglass may also be selectively deposited around the conductive conduit 48 to encapsulate the conductive conduit. As another example, any suitable type of particles may be selectively deposited around headliner components such as air ducts, fasteners, wires and hoses to encapsulate these structures and hold them in place. As yet another example, relatively fine denier fibers may be deposited throughout the particulate layer 16 to provide effective and selective sound attenuation capabilities to the headliner assembly 12. Greater amounts of such fibers may also be deposited in portions of the particulate layer 16 to be located above high use areas in the vehicle, such as the driver's seat, in order to maximize sound attenuation in those areas. The particles may also be selectively deposited to form multiple particulate layers 16. For instance, a lofted particulate layer of relatively fine denier fibers for providing optimal sound attenuation, may be deposited between two rigid and more dense particulate layers of high strength fibers, which may be used to provide support. Advantageously, the particles may also be selectively deposited so as to substantially define the final outline of the headliner assembly 12, including defining openings for such components as a sunroof, sunvisor mounting brackets and/or dome lights. Consequently, the amount of offal or excess material can be greatly reduced and method steps eliminated compared with prior art methods in which material is cut away to form necessary openings.

A binder material is preferably applied during and/or after deposition of the particles to adhere the particles together. As previously mentioned, one of the material sources 28, 30 and 32 preferably contains a heat-activatable binder material, such as a thermoplastic fiber or other particle having a relatively low melting temperature component. Such a binder material may be blown or otherwise deposited onto the particulate layer 16 using heated air having a temperature sufficient to melt the low melting temperature component. Alternatively, any suitable binder material may be used, such as a urethane spray or an adhesive mist, or the binder material may be eliminated if, for example, the particles are self-adhering, such as low melt/bicomponent polyester fibers, or the cover layer 14 and/or scrim layer 42 have sufficient strength to support the particulate layer 16.

The method continues by removing the headliner assembly 12 from the porous member 18 and transferring the headliner assembly 12 to a heating device, such as the oven 22. The oven 22 may have any suitable configuration sufficient to heat the cover layer 14, if used, and particulate layer or layers 16, and to reactivate the heat-activatable binder material, if used. Alternatively, the heating device may be a heated air source, a steam source, a contact heater with one or more heat-conducting surfaces which may be applied to one or more surfaces of the material to be heated, or any other heating means known to those skilled in the art. The headliner assembly 12 is then inserted into the mold 24 where it is thermoformed into the desired final shape and/or thickness. Thermoforming as used in this application means compressing and/or shaping heated material using any suitable device. Because the particulate layer 16 preferably has substantially the same shape as the desired final headliner assembly 12, minimal drawing and thinning out of the particulate layer 16 occurs during the thermoforming process. If the particulate layer 16 comprises thermosetting material, then the particulate layer may be formed and then heated to cure the particulate layer, or the particulate layer may be simultaneously formed and cured using a heated mold.

Figure 3:
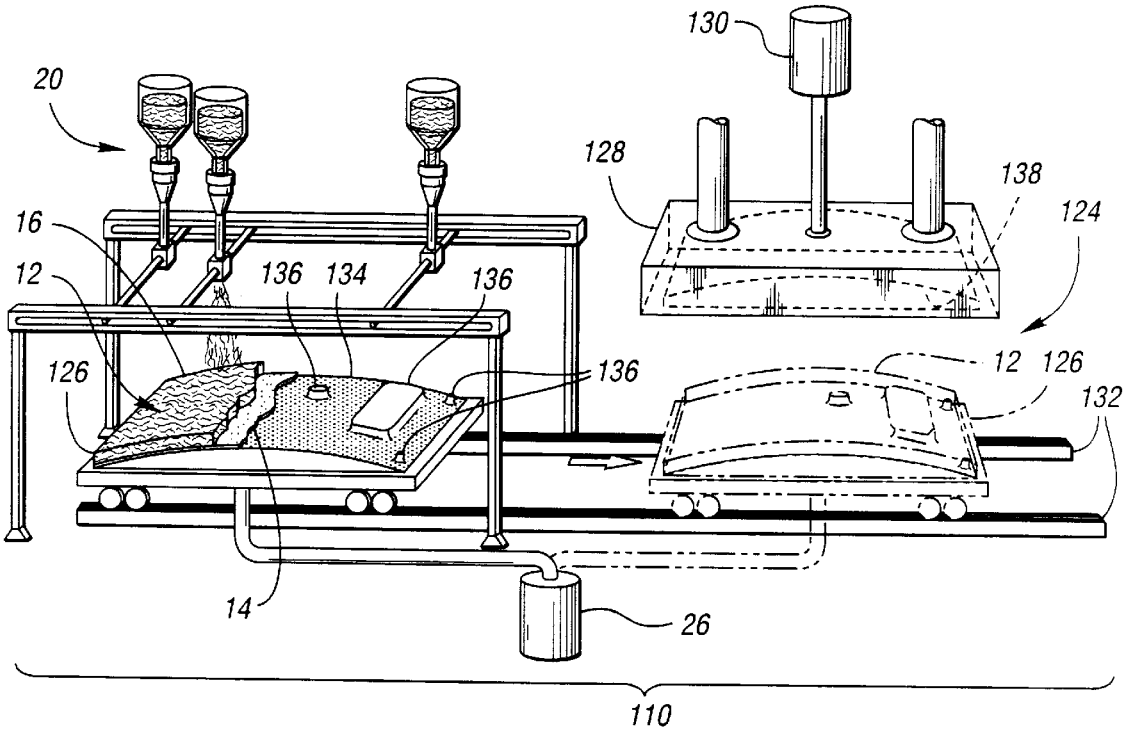
FIG. 3 is a schematic perspective view of a second embodiment of the apparatus for practicing the method according to the invention.

FIG. 3 shows a second embodiment 110 of the apparatus for manufacturing the headliner assembly 12. The apparatus 110 includes a particulate depositing device, such as the particulate applicator 20, the vacuum source 26, a mold 124 having first and second mold portions 126 and 128, respectively, and a heat source 130. The first mold portion 126 is movable along a track 132 between a first position disposed beneath the particulate applicator 20 and a second position disposed beneath the second mold portion 128. Alternatively, the particulate applicator 20 may be configured such that it can be sufficiently moved away from the first mold portion 126 in order to allow the mold portions 126 and 128 to be closed together. The first mold portion 126 has a first porous member or surface 134 having the desired contour of the final headliner assembly 12. A plurality of projections 136 extend from the porous surface 134. The projections 136 correspond with openings in the headliner assembly 12 for receiving components such as a sunroof, sunvisor mounting brackets and/or a dome light. Alternatively, the porous surface 134 may be provided without any projections 136. The vacuum source 26 is connected to the mold portion 126 for drawing air through the porous surface 134.

The second mold portion 128 preferably has a second porous surface 138 which is in fluid communication with the heat source 130. The heat source 130 may be used to generate and blow steam, heated air, or other heated fluid into the mold 124 to heat the particulate layer 16 and the cover layer 14, if used. Alternatively, the mold portions 126 and 128 can be thermally regulated in any manner known to those skilled in the art.

The method of making the headliner assembly 12 using the apparatus 110 is similar to the method described above with respect to the apparatus 10. The method includes positioning the cover layer 14, if used, on the porous surface 134. The method continues by selectively depositing particles onto the cover layer 14, or the porous surface 134 if no cover layer is used, using the particle applicator 20 to form the particulate layer or layers 16. The vacuum source 26 is preferably activated simultaneously with the deposition of particles onto the cover layer 14 to draw air through the cover layer 14 and the porous surface 134, thereby drawing the particles against the cover layer 14 and the porous surface 134. Because the projections 136 may be provided without pores, and may extend beyond the desired thickness of the particulate layer or layers 16, the projections 136 may inhibit particles from being deposited in areas that correspond with above described openings in the headliner assembly 12.

Next, the mold portions 126 and 128 are moved toward each other such that the porous surface 138 is in sufficient heat transfer relationship with the particulate layer or layers 16 and the cover layer 14. Heated fluid from the heat source 130 is then blown into the mold 124 through the porous surface 138 to heat the particulate layer or layers 16 and the cover layer 14. The vacuum source 26 may be used to assist in the heating process by drawing the heated fluid through the particulate layer or layers 16 and the cover layer 14. After sufficient heating in accordance with the specifications of the particular particles used, the mold portions 126 and 128 are closed together, thereby thermoforming the headliner assembly 12.

The invention has been described in an illustrative manner, and it is to be understood that the terminology which has been used is intended to be in the nature of words of description rather than of limitation. Obviously, many modifications and variations of the invention are possible in light of the above teachings. For example, the method and apparatus may be used to form various automotive articles such as package trays, door panels, trunk liners, floor liners and hood insulators. It is, therefore, to be understood that within the scope of the appended claims, the invention may be practiced otherwise than as specifically described.

What is claimed is:

1. A method of making a vehicle headliner assembly, comprising:

providing a porous member having first and second sides;

developing a negative pressure on the second side of the porous member;

selectively depositing particulate material from at least two sources proximate the first side of the porous member to form a particulate layer, the particulate material being drawn toward the first side of the porous member by the negative pressure developed on the second side of the porous member; and forming the particulate layer into a desired final shape so as to form the headliner assembly such that the headliner assembly includes a structural characteristic and a sound attenuation characteristic, wherein one of the at least two sources of particulate material includes particles configured to provide the structural characteristic, and another of the at least two sources of particulate material includes particles configured to provide the sound attenuation characteristic.

2. The method of claim 1 further comprising positioning at least one permeable layer on the first side of the porous member prior to selectively depositing the particulate material.

3. The method of claim 2 wherein the at least one permeable layer includes a cover layer.

4. The method of claim 2 wherein the at least one permeable layer includes a scrim layer.

5. The method of claim 4 further comprising positioning a cover layer over the particulate layer prior to forming the particulate layer into a desired final shape.

6. The method of claim 1 wherein the porous member its an element of a mold, and the forming step comprises thermoforming the particulate layer in the mold.

7. The method of claim 1 wherein selectively depositing particulate material comprises blowing particulate material.

8. The method of claim 7 wherein blowing particulate material comprises blowing particulate material using a plurality of applicator heads, wherein at least one of the applicator heads blows particulate material from one of the at least two sources, and another applicator head blows particulate material from another of the at least two sources.

9. The method of claim 1 wherein selectively depositing particulate material comprises varying the density of particulate material so as to form at least one reinforcing zone in the headliner assembly.

10. The method of claim 1 wherein selectively depositing particulate material comprises selectively depositing resilient particles so as to form at least one energy management zone in the headliner assembly.

11. The method of claim 1 wherein selectively depositing particulate material comprises selectively depositing conductive particles so as to form a conductive conduit in the headliner assembly.

12. The method of claim 11 wherein selectively depositing particulate material includes selectively depositing electrically insulating particles around the conductive conduit.

13. The method of claim 1 further comprising providing a headliner component, wherein selectively depositing particulate material comprises selectively depositing particulate material so as to encapsulate the headliner component within the particulate layer.

14. The method of claim 1 wherein the particulate material includes fibers having a first denier and fibers having a second denier greater than the first denier.

15. The method of claim 1 wherein the particulate material consists essentially of non-fiberglass particulate material.

16. The method of claim 1 wherein the particulate layer to includes at least two portions having different densities.

17. The method of claim 1 further comprising depositing particulate material to form a second particulate layer, the second particulate layer having a density greater than the density of the first particulate layer.

18. The method of claim 1 further comprising depositing meltable binder material with the particulate material.

19. The method of claim 18 further comprising heating the particulate layer to melt the binder material prior to forming the particulate layer into the desired final shape of the headliner assembly.

20. A method of making a vehicle headliner assembly, comprising:

positioning a permeable cover layer on a first side of a porous member;

developing a negative pressure on a second side of the porous member;

selectively depositing particulate material from at least two different sources of particulate material at different areas on the cover layer in amounts commensurate with desired thicknesses of the headliner assembly at the different areas to form a particulate layer, the particulate material being drawn to the cover layer by the negative pressure developed on the second side of the porous member; and thermoforming the cover layer and the particulate layer to form the headliner assembly such that the headliner assembly includes a structural characteristic and a sound attenuation characteristic, wherein one of the at least two sources of particulate material includes particles configured to provide the structural characteristic, and another of the at least two sources of particulate material includes particles configured to provide the sound attenuation characteristic.

21. The method of claim 20 wherein the porous member is an element of a mold, and the thermoforming step comprises thermoforming the cover layer and the particulate layer in the mold.

22. The method of claim 20 wherein selectively depositing particulate material comprises blowing particulate material using a plurality of applicator heads, wherein at least one of the applicator heads blows particulate material from one of the at least two sources, and another applicator head blows particulate material from another of the at least two sources.

23. The method of claim 20 wherein selectively depositing particulate material comprises varying the density of particulate material to form at least one reinforcing zone in the headliner.

24. The method of claim 20 wherein selectively depositing particulate material comprises selectively depositing resilient particles so as to form at least one energy management zone in the headliner assembly.

25. The method of claim 20 wherein selectively depositing particulate material comprises selectively depositing conductive particles so as to form a conductive conduit in the headliner assembly.

26. The method of claim 20 further comprising providing a headliner component, wherein selectively depositing particulate material comprises selectively depositing particulate material so as to encapsulate the headliner component within the particulate layer.

27. The method of claim 20 wherein the particulate material selectively deposited from at least one of the particulate material sources consists essentially of non-fiberglass particulate material.

28. The method of claim 20 wherein the particulate layer includes at least two portions having different densities.

29. The method of claim 20 further comprising depositing a heat-activatable binder material with the particulate material.

30. The method of claim 29 further comprising heating the particulate layer to activate the heat-activatable binder material prior to thermoforming the particulate layer.

31. The method of claim 20 wherein the one of the at least two sources of particulate material includes fibers having a first denier for providing the structural characteristic, and the another of the at least two sources of particulate material includes fibers having a second denier greater than the first denier for providing the sound attenuation characteristic.

32. The method of claim 20 wherein selectively depositing particulate material comprises selectively depositing particulate material so as to define at least one opening extending through the particulate layer.

33. A method of making a headliner assembly using a mold including first and second mold portions, wherein the first mold portion has a first porous surface in fluid communication with a vacuum source, and the second mold portion has a second porous surface in fluid communication with a heat source, the method comprising:

positioning a permeable cover layer on the first porous surface;

activating the vacuum source to draw air through the cover layer;

selectively depositing particulate material including heat-activatable binder material on the cover layer to form a particulate layer having a shape conforming with a desired final shape of the headliner assembly, the particulate material being drawn against the cover layer by the air drawn through the cover layer;

moving the mold portions toward each other such that the second porous surface is in heat transfer relationship with the particulate layer;

introducing heated fluid through the second porous surface to heat the particulate layer so as to activate the heat-activatable binder material; and thermoforming the cover layer and the heated particulate layer to form the headliner assembly.

34. The method of claim 33 wherein selectively depositing particulate material comprises selectively depositing resilient particles so as to form at least one energy management zone in the headliner assembly.

* * * * *

UNITED STATES PATENT AND TRADEMARK OFFICE

CERTIFICATE OF CORRECTION

PATENT NO. : 6,153,144

DATED : November 28, 2000

INVENTOR(S) : George B. Byma

It is certified that error appears in the above-identified patent and that said Letters Patent is hereby corrected as shown below:

Column 6, Line 65, Claim 6, "its" should be --is--;

Column 7, Line 34, Claim 16, delete "to";

Column 8, Line 17, Claim 22, after "headliner" insert --assembly--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*